United States Patent [19]

Paul

[11] Patent Number: 4,792,235

[45] Date of Patent: Dec. 20, 1988

[54] GASEOUS FLUID SUPPLY SYSTEM FOR A VESSEL

[75] Inventor: Kermit D. Paul, Bethlehem, Pa.

[73] Assignee: Fuller Company, Bethlehem, Pa.

[21] Appl. No.: 99,264

[22] Filed: Sep. 21, 1987

[51] Int. Cl.[4] ..... B01F 13/02

[52] U.S. Cl. ..... 366/107; 222/195; 406/15; 406/134; 406/136; 406/137

[58] Field of Search ..... 366/30–33, 366/37, 131, 132, 136, 348, 349, 101–107; 222/195; 406/14, 15, 93–95, 134, 136, 137

[56] References Cited

U.S. PATENT DOCUMENTS

| | | | |
|---|---|---|---|
| 3,905,650 | 9/1975 | Freeman | 406/136 X |
| 3,976,331 | 8/1976 | Kluger et al. | 406/15 |
| 4,059,311 | 11/1977 | Spitzer et al. | 222/195 X |
| 4,223,044 | 9/1980 | Se | 366/101 X |
| 4,389,143 | 6/1983 | Nadin et al. | 406/95 X |
| 4,515,503 | 5/1985 | Snowdon | 406/95 X |
| 4,569,596 | 2/1986 | Romanchik et al. | 366/107 |
| 4,642,944 | 2/1987 | Fairhurst et al. | 222/195 X |

*Primary Examiner*—Harvey C. Hornsby
*Assistant Examiner*—Stephen F. Gerrity
*Attorney, Agent, or Firm*—Frank H. Thomson

[57] ABSTRACT

A system for supplying a gas under pressure to a vessel such as a blender for particulate material which includes a central vertical lift column for recirculating material through the vessel to achieve blending. The system uses a first source of gas under pressure which may be a low pressure source suitable for a continuous operation of the blending apparatus. The system also is connected to a high pressure source of air such as plant air which is utilized as a supplemental source of air under pressure for initial start-up of the apparatus. A control system is provided which regulates the flow of the high pressure air to the gas supply conduit which acts as a reservoir for high pressure air. The control system allows the gas supply conduit to be pressurized. This high pressure source flows rapidly to the vessel at start-up to break an initial head of material which may be lodged in the vertical lift column of the blending apparatus thereafter the high pressure source of air is no longer utilized in normal blending operation.

4 Claims, 1 Drawing Sheet

GASEOUS FLUID SUPPLY SYSTEM FOR A VESSEL

BACKGROUND OF THE INVENTION

This invention relates to an apparatus and system for supplying gaseous fluid under pressure to a vessel containing material. More particularly, the invention relates to an apparatus for supplying gaseous fluid under pressure to a apparatus for blending particulate material.

Prior to the present invention, blenders for particulate material such as plastic pellets are known. The blenders of the type to which the present invention relate include a vessel which may have a vertically oriented lift pipe mounted in the center of the vessel which serves as a means for circulating material in the bottom of the vessel to the top of the vessel. This is accomplished by supplying gaseous fluid or air under pressure to the bottom of the vessel to be directed up through the vertical lift pipe. This air under pressure entrains material in the bottom vessel conveys it up through the lift pipe and the material is discharged from the lift pipe in a geyser-like manner into the top of the vessel to thereby circulate material through the vessel. In order to carry out this circulation of material through the lift pipe, it is necessary to employ a given gas velocity at a given pressure. However, during the start-up phase of the blending of material, the vessel may contain a quantity of material which is at rest and the lift pipe may be partially filled with material. In order to commence the circulation of material through the lift pipe and hence blending of material. It is necessary to overcome the static head of material which may be contained within the lift pipe and/or within the vessel surrounding the inlet to the lift pipe.

In order to provide the necessary pressure, systems usually include a rotary positive displacement blower or other medium pressure gas supply device supplying gas under pressure in the range of about 4 to 6 pounds per square inch with gas velocities on the order of 2500 to 3500 feet per minute. This pressure is higher than that which is required during the normal operation of the system after start-up. During normal operation, air under pressure in the range of about 1½ to 2½ pounds per square inch is required. Such pressure and the required volume can be supplied by a lower pressure centrifugal blower or high pressure fan.

A centrifugal blower or high pressure fan has a lower initial capital cost and lower maintenance requirements than a rotary positive displacement blower. With a centrifugal blower, the motor will not be overloaded when the discharge air flow is reduced to zero and does not require a safety release valve at that condition. Further, a centrifugal blower or a high pressure fan is much quieter than a rotary positive displacement blowerr and therefore silencers are not required during operation. For these reasons, it would be desirable to be able to use a centrifugal blower or high pressure fan in a blending system for particulate material rather than a rotary positive displacement blower, but there are certain disadvantages. Unfortunately, the basic performance characteristics of a centrifugal blower or high pressure fan lack the high pressure surge capabilities to break through an initial head of material in the vessel such as during start-up or blender restart.

SUMMARY

It is therefore the principal object of this invention to provide a lower cost system for supplying gaseous fluid under pressure to a vessel for material including specifically particulate material.

It is a further object of this invention to provide a system for supplying gaseous fluid under pressure to a vessel for blending particulate material which is capable of utilizing a centrifugal blower or high pressure fan as the source of gaseous fluid under pressure for both start-up and continuous operation.

In general, the foregoing and other objects will be carried out by providing in an apparatus for blending particulate material including a vertically oriented vessel having a centrally mounted vertical lift pipe having a material inlet near the bottom of the vessel and a material outlet near the top of the vessel, said vessel having an inlet for gaseous fluid near the bottom whereby gaseous fluid under pressure is supplied to the bottom of the vessel for entraining material in the vessel and conveying said material through the vertical lift pipe from its inlet to its outlet for discharge into the top of the vessel, an improved gaseous fluid supply system comprising a first source of gaseous fluid capable of providing gas at a pressure sufficient to circulate material in the vessel through said lift pipe but insufficient to overcome an initial head of material in the vessel encountered at start-up of the apparatus; and conduit means flow connecting said first source to the inlet for gaseous fluid of said vessel; a second source of gaseous fluid flow connected to said conduit means for pressuring said conduit means to a pressure sufficient to overcome an initial head of material in said vessel; and control means for regulating the supply of gaseous fluid from said first source and said second source to said conduit means and from said conduit means to the inlet for gaseous fluid of said vessel.

According to the present invention, the gaseous fluid supply conduit acts as a small receiver which is pressurized prior to initial start-up. This pressurization takes place by operating the centrifugal blower or fan to pressurize the conduit to a first pressure which is the full capabilities of the blower or fan, i.e., up to a pressure corresponding to the zero flow pressure capability of the fan. The conduit is also connected to a second source of gas under pressure such as plant air which is normally in the range of 100 psig. The plant air is utilized to pressurize the gas supply conduit to a pressure which is adequate to break the initial head of material and commence material circulation. When the conduit is pressurized to the desired level, the main air supply valve to the vessel can be opened to allow a sudden release of high pressure air in the conduit to break the head of material in the vessel and commence the blending operation. Continued blending is sustained by the continued supply of gaseous fluid at the first, lower pressure of the centrifugal blower or fan. An appropriate control scheme is provided for controlling the pressurizing of the conduit and the release of pressure from the conduit to the blending vessel.

BRIEF DESCRIPTION OF THE DRAWING

The invention will be described in connection with the annexed drawing wherein.

DESCRIPTION OF THE PREFERRED EMBODIMENT

Figure 1:
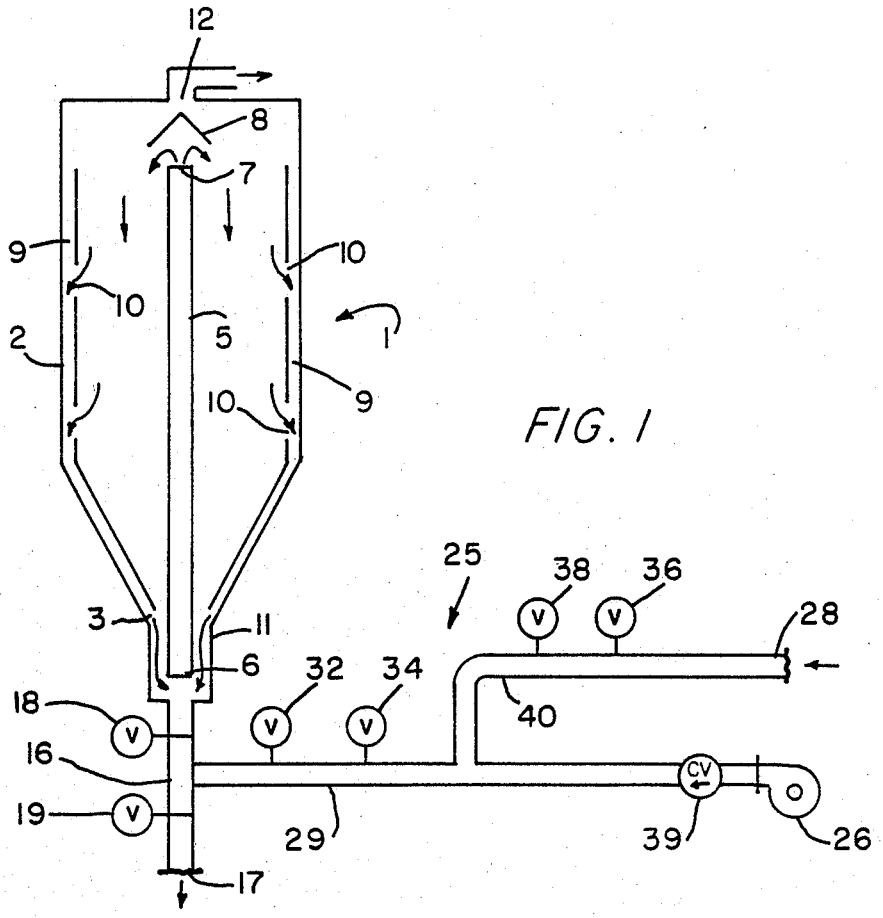
FIG. 1 is a diagramatic view of a blender for particulate material.
Figure 2:
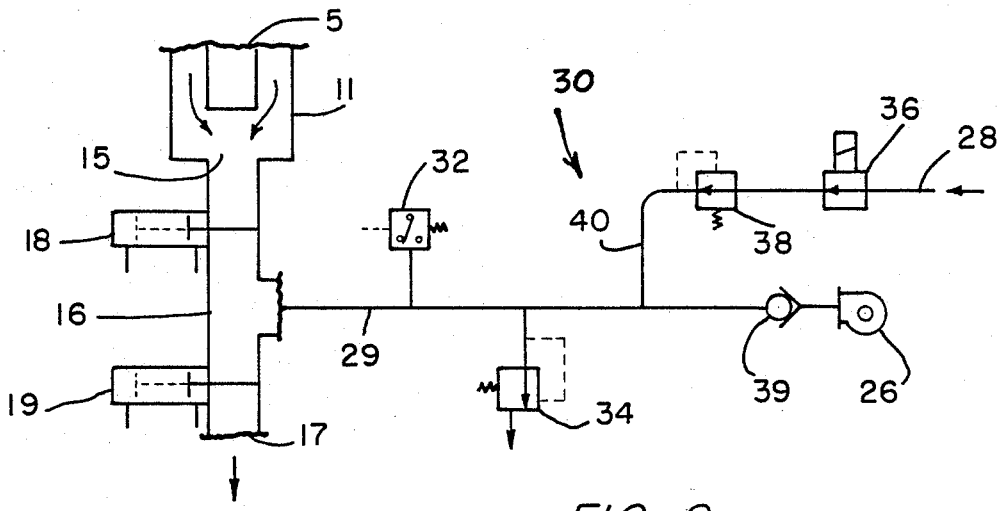
FIG. 2 is a diagramatic view of the control scheme of the present invention.

The present invention is particularly directed for use in conjunction with a blender for particulate material, but it is to be understood that it is useful in other applications where it is desired to supply gas under pressure to a vessel which contains particulate material and where it may be necessary to overcome a head of material. It may also be useful in other applications where it is necessary to supply gas under pressure to vessels where it is necessary to overcome an initial back pressure while continued operation can be carried out at a lower pressure.

The invention is described as appliced to a blending apparatus generally indicated at 1. This blending apparatus will include an upright vessel 2 with a suitable inlet for material such as plastic pellets to be blended either in the bottom of the vessel or in the top of the vessel. The vessel illustrated includes a vertically oriented centrally mounted lift pipe 5 having a lower material inlet 6 and an upper material outlet 7. A distributor cone 8 may be mounted above the outlet 7. A plurality of circumferentially spaced apart downcomers 9 each having vertically spaced material inlets 10 may be provided inside the vessel. Material enters the downcomers through inlets 10 and is supplied from the upper part of the vessel for discharge through outlets 3 to a lower region 11 of the vessel 1. Gas under pressure is supplied to the bottom of the vessel through a inlet 15 for gaseous fluid under pressure. The gaseous fluid under pressure will be directed into the inlet 6 of the lift pipe 5 for entraining material which may be in the lower region 11 of vessel 2 and conveying it up through the pipe 5 to be discharged in a geyser like manner through the outlet 7 into the top of the vessel. This circulation of material from the upper region, through downcomers 9 to lower region 11 and from the region 11 to the top of the vessel causes a circulation or blending of material which is within the vessel. A vent 12 may be provided for discharging spent blending gas from the vessel.

The blender itself and its operation are described in greater detail in U.S. Pat. No. 4,569,596 issued Feb. 11, 1986, and U.S. patent application Ser. No. 06/848,005 filed Apr. 3, 1986 (copending) and need not be described in further detail herein.

The inlet 15 for gas under pressure is connected to a conduit 16 which serves as a supply conduit for gas under pressure from the source and control system to be described and an outlet for blended particulate material; in this later use it is connected to a material withdrawal line 17. A main air valve 18 and a material outlet valve 19 are positioned within the conduit 16. In operation, when material is being blended, the valve 19 is closed and the valve 18 is open. When it is desired to withdraw material from the vessel both the valve 18 and the valve 19 will be open.

The system for supplying gaseous fluid under pressure is generally indicated at 25 and includes a first source 26 for gaseous fluid at a first pressure. This source 26 may be in the form of a high pressure fan or centrifugal blower which typically may be capable of supplying air at 3 psi. The system 25 also includes a second source 28 of gaseous fluid under pressure. The source 28 is at a second pressure higher than the first source and may be available plant air which can supply air under pressure up to 100 psig. This high pressure source will have other uses in the facility in which the blender is located and therefore does not involve a separate capital cost allocation to the blending apparatus other than the connection valves and control scheme contemplated by the present invention. Each of the sources of gas under pressure is connected to a conduit means 29 for supplying gaseous fluid under pressure to the conduit 16 and the inlet 15 for gas under pressure of the vessel 2.

The invention includes a control means generally indicated at 30 for regulating the supply of gaseous fluid from the first source 26 and the second source 28 to the conduit means 29 and from the conduit 29 to the inlet 15 for gaseous fluid. This control means 30 includes a first pressure responsive valve 32 for controlling the flow of gas from the conduit 29 to the vessel through inlet 15. This valve is set to open when the pressure in the conduit 29 exceeds a predetermined maximum which maximum pressure may be on the order of 6 psig or slightly higher than that which is necessary to commence initial operation of the blender and break the initial head of material. The control scheme may also include a pressure relief valve 34 connected to the conduit 29 for relieving pressure in the conduit if the pressure exceeds a higher predetermined safety pressure. Valve 34 is shown as typically applied as good design practice, not as a required item to make the invention functional.

The control scheme 30 also includes a second valve 36 positioned in a conduit 40 flow connecting the second source 28 to the conduit 29 for controlling the flow of gas from the second source 28 to the conduit 29. The valve 36 is an on/off (2 way) solenoid valve. The valve 36 is adapted to be closed when the blender is not being started. The control system 30 also includes a third valve 38 for regulating the pressure of gas supplied by the second source to the conduit 29. A check valve 39 is included between the first low pressure source of gas 26 and the conduit 29 so that when high pressure is within the conduit 29 it does not flow back through the fan 26.

In operation, when the vessel 2 is filled with material, there is a head of material within the vessel in the lower region 11 and may be a head of material within the lift pipe 5. In order to overcome this head of material so that material may be lifted up through pipe 5 to begin circulation, a certain pressure gas such as 6 psig may be required which pressure is higher than during normal sustained operation. In the present invention, the conduit 29 may serve as a reservoir or receiver for high pressure air. The conduit 29 is pressurized to a pressure sufficient to overcome the head of material by using a combination of the low pressure air source 26 and the high pressure air source 28. With the main air valve 18 and the material withdrawal valve 19 closed, the blower or fan 26 is started. This blower will immediately pressurize the conduit 29 to a pressure corresponding to the zero flow pressure capability of the fan 26. At the same time the blower 26 starts, the valve 36 is opened to allow a small amount of high pressure air from source 28 to pressurize the conduit 40 and the conduit 29. This pressure is regulated by pressure regulator 38 to thereby set the desired predetermined pressure. It is noted that if the blender and the blower 26 are close coupled to each other so that the conduit 29 is short, then it may be necessary to have a small receiver in the line 29 to provide an adequate volume of the higher pressure gas. The relief valve 34 serves as a pressure safety switch to insure a maximum pressure in the conduit 29 in the event of a failure of the valve 38.

The first pressure responsive valve or pressure switch 32 is set at the predetermined maximum pressure. When the predetermined pressure in conduit 29 is reached, the second valve 36 is closed so that no additional air is supplied from the source 28 to the conduit 29. When it is desired to start up the system then the main air valve 18 and the first pressure responsive valve 32 are opened simultaneously. At this instant, the pressurized air trapped within the conduit 29 between the check valve 39 and the inlet 15 will rush into the blender and be directed up through the lift pipe carrying the residual particulate material that may have been lodged within the lift pipe 5 from a previous shutdown.

When the pressure in the conduit 29 falls below the zero flow pressure of the blower 26, the check valve 39 will allow the blower to supply a continuous source of gas under pressure through conduit 29 to the inlet 15 for carrying out a continuous blending operation at the lower pressure capability of the fan or blower 26.

When it is desired to remove blended material from the vessel 2, the air supply through conduit 29 can be shut off and the valves 18 and 19 opened so that material will be discharged through outlet 17.

The specific valves to be utilized with the present invention are well known and those skilled in the art will be able to properly select the correct size and capacity valve depending upon the specific application.

It can be seen from the foregoing that the objects of the invention have been carried out. A system has been provided for supplying a short burst of high pressure air to the blending apparatus to overcome a head of material which may be contained within the vessel. However, the system utilizes a low capital cost centrifugal blower or fan for continuous operation.

It is intended that the foregoing describe a preferred embodiment of the invention but that the invention be limited solely by that which is within the scope of the appended claims.

I claim:

1. In an apparatus for blending particulate material including a vertically oriented vessel having a centrally mounted vertical lift pipe having a material inlet near the bottom of the vessel and a material outlet near the top of the vessel, said vessel having an inlet for gaseous fluid near the bottom whereby gaseous fluid under pressure is supplied to the bottom of the vessel for entraining material in the vessel and conveying said material through the vertical lift pipe from its inlet to its outlet for discharge into the top of the vessel, an improved gaseous fluid supply system comprising a first source of gaseous fluid capable of providing gas at a pressure sufficient to circulate material in the vessel through said lift pipe but insufficient to overcome an initial head of material in the vessel encountered at start-up of the apparatus; and conduit means flow connecting said first source to the inlet for gaseous fluid of said vessel; a second source of gaseous fluid flow connected to said conduit means for pressurizing said conduit means to a predetermined pressure sufficient to overcome an initial head of material in said vessel; and control means for regulating the supply of gaseous fluid from said first source and said second source to said conduit means and from said conduit means to the inlet for gaseous fluid of said vessel; said control means including a first valve mounted in said conduit between said first and second source of gaseous fluid under pressure and said inlet for gaseous fluid for controlling the supply of gaseous fluid from said conduit to said inlet for gaseous fluid; and a second valve positioned between said second source of gaseous fluid under pressure and said conduit means for controlling the flow of gaseous fluid under pressure from said second source to said conduit; said second valve being adopted to close when the pressure in the conduit reaches said predetermined maximum pressure and said first valve is adapted to be opened at start-up of the blender after said predetermined maximum pressure is reached while gaseous fluid continues to be supplied to said conduit from said first source.

2. In an apparatus for blending particulate material according to claim 1, wherein said control means including a third valve positioned between said second source of gaseous fluid and said conduit means for regulating the pressure of gas supplied by said second source to said conduit.

3. In an apparatus for blending particulate material according to claim 2, wherein said first valve is a pressure responsive valve and further comprising a main air inlet valve between said conduit and the inlet for gaseous fluid; said main air inlet valve being closed when said second source of gaseous fluid is used to pressurize said conduit and said first valve and said main air inlet valve are adapted to be opened substantially simultaneously at start-up of the blender.

4. In an apparatus for blending particulate material according to claim 3 further comprising a check valve positioned between said first source of gaseous fluid and said conduit.

* * * * *